US005482488A

United States Patent [19]

Plummer

[11] Patent Number: 5,482,488

[45] Date of Patent: Jan. 9, 1996

[54] STRAP ON BOUNCEABLE BELL TOY AND METHOD OF USING THE SAME

[76] Inventor: Donna M. Plummer, #151 Rte. 125, Barrington, N.H. 03825

[21] Appl. No.: 326,469

[22] Filed: Oct. 20, 1994

[51] Int. Cl.[6] ..... A63H 33/00; A63H 5/00

[52] U.S. Cl. ..... 446/28; 446/419; 273/DIG. 19

[58] Field of Search ..... 446/26, 27, 28, 446/397, 404, 408, 418, 419, 421, 422, 431, 437; 273/55 C, 58 C, 58 E, DIG. 17, DIG. 19; 84/406, 402, 453

[56] References Cited

U.S. PATENT DOCUMENTS

| | | | |
|---|---|---|---|
| 331,004 | 11/1885 | Reilly | 446/28 |
| 847,307 | 3/1907 | Bailey | 84/406 |
| 2,784,526 | 3/1957 | Bounadere | 446/419 |
| 3,528,654 | 9/1970 | Larsen et al. | 446/26 X |
| 3,859,886 | 1/1975 | Brisco, Sr. | 446/28 X |
| 3,868,786 | 3/1975 | Lippe et al. | 446/28 |
| 4,021,035 | 5/1977 | O'Hara | 273/DIG. 19 X |
| 4,059,271 | 11/1977 | Dupre | 273/DIG. 19 X |
| 4,498,613 | 2/1985 | Donahue et al. | 446/28 X |
| 4,765,748 | 8/1988 | Fidelgo | 273/DIG. 19 X |

FOREIGN PATENT DOCUMENTS

| | | | |
|---|---|---|---|
| 736357 | 6/1966 | Canada | 446/28 |

*Primary Examiner*—Robert A. Hafer
*Assistant Examiner*—D. Neal Muir
*Attorney, Agent, or Firm*—Davis, Bujold & Streck

[57] ABSTRACT

The invention relates to a novel toy which is releasably fastened to a desired part of the user's body, e.g. about the waist or about the thigh of a user via a belt member. Preferably the belt member is adjustable and supports a plurality of padded or cushioned bell members, via a plurality of support straps and protective covering, adjacent a desired portion of the thighs of the user so that the bell members may be bounced into the air, by the user's thigh, to assist the user with developing his/her eye and thigh coordination and/or improve the rhythm of the user. The bell members may have different shapes and/or sizes so that each bell member will generate a unique sound when struck and bounced in the air thereby allowing the user to play music and develop rhythm. The invention also relates to a method of using the bounceable bell toy.

16 Claims, 2 Drawing Sheets

FIG. 1
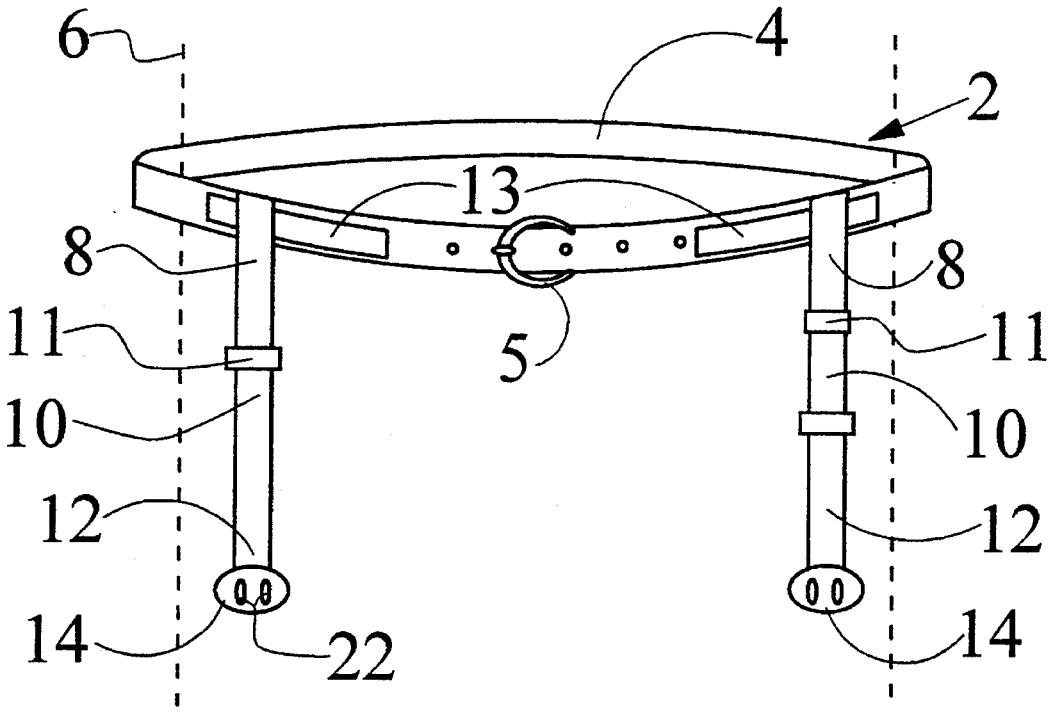
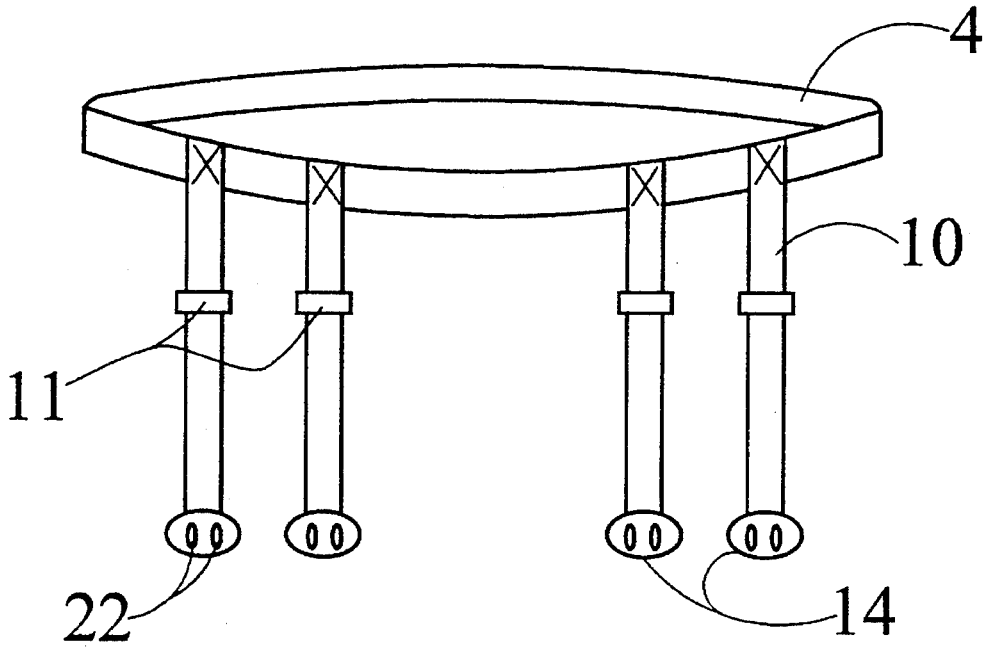
FIG. 2

FIG. 3
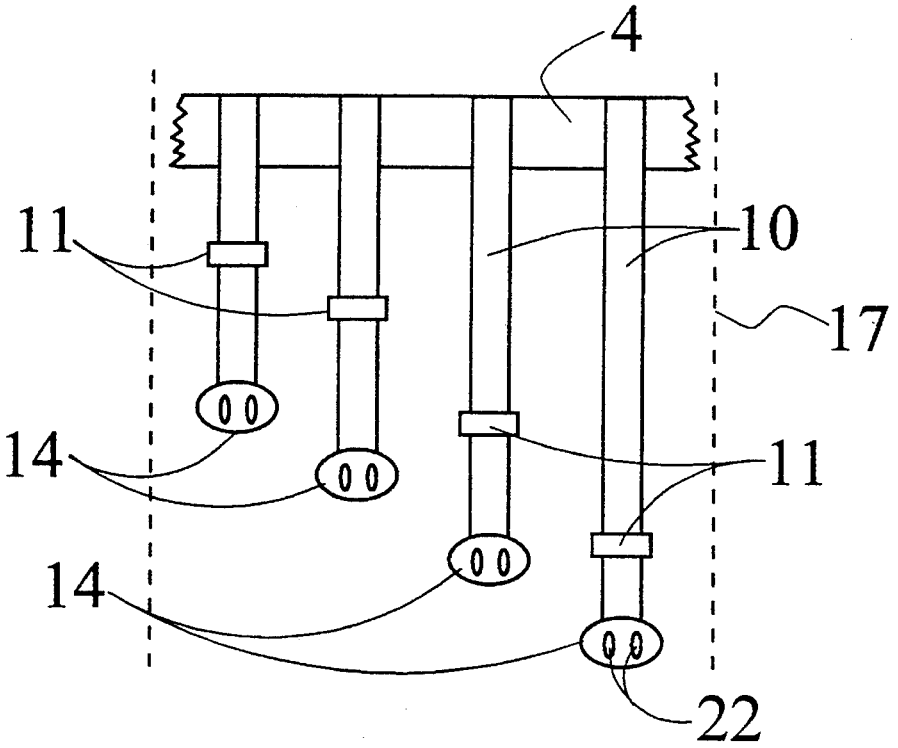
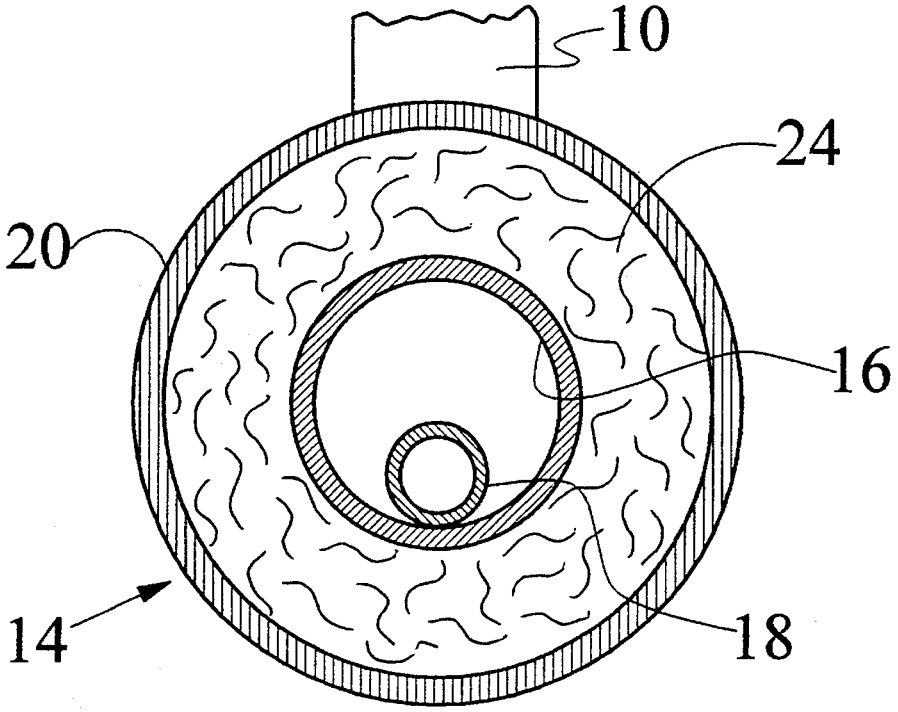
FIG. 4

STRAP ON BOUNCEABLE BELL TOY AND METHOD OF USING THE SAME

FIELD OF THE INVENTION

This invention relates to a novel bounceable bell toy and, in particular, a strapping mechanism for strapping a plurality of bounceable bells to a desired part of the user's body so that the bells are located adjacent the thigh portion of the user and can be readily bounced by the user raising his/her thigh to develop eye and thigh coordination and generate music.

BACKGROUND OF THE INVENTION

There are a variety of toys presently available on the market but none of the toys currently available are able to help the eye and thigh coordination of a user while generating music and/or assist with improving and/or developing rhythm of the user.

SUMMARY OF THE INVENTION

Wherefore, it is an object of the invention to provide a toy which is fun to play with while also developing the eye and thigh coordination of the user.

A further object of the invention is to provide a toy which can be used to generate music and assists the user with improving his or her rhythm and/or coordination.

The present invention relates to a bounceable bell toy for assisting a user with developing eye and thigh coordination, said toy comprising a belt member for securing the toy to a desired portion of a user's body; a least two strap supports having first and second opposed ends, the first end of each strap support being secured to the belt member and the second end of each strap support being secured to a protective casing; and a plurality of bell members each comprising an exterior casing supporting an interior clapper, and one of said plurality of bell members being supported within each said protective casing; and a layer of padding being provided between an exterior surface of the exterior casing and an inner surface of the protective casing to prevent injury to a thigh of a user while playing with the toy.

The present invention also relates to a method of utilizing a bounceable bell toy comprising a belt member for securing the toy to a desired portion of a user's body; a least two strap supports having first and second opposed ends, the first end of each strap support being secured to the belt member and the second end of each strap support being secured to a protective casing; and a plurality of bell members each comprising an exterior casing supporting an interior clapper, and one of said plurality of bell members being supported within each said protective casing; and a layer of padding being provided between an exterior surface of the exterior casing and an inner surface of the protective casing to prevent injury to a thigh of a user while playing with the toy, said method comprising the steps of securely fastening the belt member to a desired portion of a body of a user; and bouncing the bell members with the thigh of the user thereby causing the bell members to bounce into the air and developing eye and thigh coordination of the user while playing with the bounceable bell toy.

BRIEF DESCRIPTION OF THE DRAWINGS

The invention will now be described, by way of example, with reference to the accompanying drawings in which:

FIG. 1 is a diagrammatic drawing showing a perspective view of the novel bell bounceable toy according to the present invention;

FIG. 2 is a diagrammatic drawing showing a perspective view of a second embodiment of the novel bell bounceable toy according to the present invention;

FIG. 3 is a partial diagrammatic drawing showing a third embodiment of the toy according to the present invention; and FIG. 4 is a diagrammatic cross-sectional view of one of the bell members according to the present invention.

DESCRIPTION OF THE PREFERRED EMBODIMENTS

Turning now to FIG. 1, a preferred form of the present invention will now be described in detail. The toy 2, according to the present invention, comprises an adjustable strapping member or belt 4 for releasably securing the toy 2 to a desired part of the user's body 6. The belt member 4 typically includes a belt buckle 5, or another adjustment member, which facilitates adjustment and attachment of the belt member 4 about a desired portion of the user's body, e.g. the user's waist. It is to be appreciated that a variety of other known adjustment members, which are well known in the art, may be utilized instead of a belt buckle. As such adjustment members are well known in this art, a further detailed description concerning the same is not provided herein.

The toy 2 is typically secured in place about the user's waist or around one of the thighs of the user via the belt member 4. A first end 8 of a support strap 10 is attached to a front portion of the belt member 4. The support straps 10 can be either permanently attached to the belt 4 (FIG. 2) or can be releasably attachable thereto, via a pair of mating touch fasteners such as VELCRO(R), to facilitate adjustment of the support straps 10 along the belt 4 (FIG. 1). One of the pair of touch fasteners 13 can be seen in FIG. 1. A second opposed end 12 of the support strap 10 has a bell member 14 attached thereto. The bell member 14 comprises a hollow exterior casing 16 (FIG. 4), typically made of metal or another suitable material, and interior ringer or clapper 18, also typically made of metal or another suitable material. Those two components are housed within a protective casing 20 which is permanently fastened to the second end of the support strap 10. The protective casing 20 is formed of a durable material which resists tears and is provided with a plurality of apertures 22 (FIGS. 1–3) to allow the sound generated during use of the toy to be readily heard by the user. A sufficient layer of padding 24, such a cotton, is located between an exterior surface of the exterior casing and an inner surface of the protective casing to prevent injury to a thigh of a user while playing with the toy. If desired, the padding may be provided only on one side of the protective casing, i.e. the side of the protective casing which will be contacted by the user's thigh during use of the toy.

The length of the support straps 10 are preferably adjustable, via adjustment mechanism 11 such as the kind typically found on suspenders, so that the position of the bell members 14 can be properly adjusted to each user of the toy 2 to provide maximum benefit from use of the toy 2. The adjustment mechanism 11 has an unlock position, in which the adjustment mechanism 11 is slidable along the strap member 10 to adjust the length of the strapping member, and a lock position in which the adjusted length of the strap member 10 is maintained. As a variety of known adjustment mechanism are well known in this art, further detailed description concerning the same is not provided herein.

Turning now to FIG. 2, a second embodiment of the present invention will now be described. This embodiment is very similar to the first embodiment except that the number of support members 10 and bell members 14 have been doubled to a total of four support members and bell members, i.e. two support and bell members will be associated with each thigh of the user in this embodiment. A further distinction between this embodiment and the first embodiment is that the belt member 4 is an endless member and is sized to have a smaller interior perimeter than an exterior perimeter of the body portion to which the toy is to be secured so that the resilient belt member 3 is resiliently expanded, when applied to that desired part of the user's body, to secure the toy in place.

FIG. 3 show a third embodiment of the present invention. This embodiment is also very similar to the first embodiment except that the number of support straps 10 and bell members 14 has been further increased to a total of eight support members and bell members, i.e. four support and bell members will be associated with each thigh 17 of the user in this embodiment. In this embodiment, the strap members 10 are adjusted so that the bell members 14 are each spaced a different distance from the belt member 4. In addition, the bell members 14 are of different sizes in order to provide a different sound when each bell member is bounced in the air.

It is to be appreciated that the shape, size and configuration of the bell members can be varied so that each bell member may produce a different and/or desired sound when bounced in the air by a thigh of a user while playing with the toy. Further, the bell members could also be manufactured from different materials to produce a desired sound when bounced in the air. It is also contemplated that the length of each support strap may be of a different length in order to maximize development of the eye and the thigh coordination of the user.

USE OF THE INVENTION

A detailed description concerning the use of the present invention will now be provided. The user first secures the toy 2 around a desired portion of the user's body, e.g. the user's waist or an upper portion of one of the user's thighs (FIG. 3). If necessary, the belt member 4 is adjusted such that the toy is securely fastened to the desired portion of the user's body. Thereafter, the length of the support straps 10 and 10' are adjusted so that the bell members 14 are located adjacent a portion of the user's leg intermediate the hip and knee cap of the user. The bell members 14 are generally positioned slightly above the knee cap, e.g. about 0.25–7 inches above the knee cap of the user and preferably about 1–4 inches above the knee cap of the user. Thereafter, the user bounces a desired one or ones of the bell members 14 with his or her thigh to develop the user's eye and thigh coordination and/or improve the rhythm of the user. The bell exterior casing and clapper can be shape and configure so as to produce a different and/or desired sound so that music may be generated by bouncing the bell members.

For example, the material for manufacturing the belt member and the straps can be any one of the following: an elastic material, a rubber material, ribbons, rope, cord, a plastic material, felt, cotton, nylon, acrylic and various other cloth types, etc. The belt member and the straps can also be manufactured from the same or different materials.

Since certain changes may be made in the above described toy without departing from the spirit and scope of the invention herein involved, it is intended that all matter contained in the above description or shown in the accompanying drawings shall be interpreted merely as examples illustrating the inventive concept herein and shall not be construed as limiting the invention.

Wherefore, I claim:

1. A bounceable bell toy for assisting a user with developing eye and thigh coordination, said toy comprising:

a belt member for securing the toy to a desired portion of a user's body;

a least two strap supports having first and second opposed ends, the first end of each strap support being secured to the belt member and the second end of each strap support being secured to a protective casing; and a plurality of bell members each comprising an exterior bell casing supporting an interior clapper for striking the bell casing and generating sound, and one of said plurality of bell members being supported within each said protective casing; and a layer of padding being provided between an exterior surface of the exterior bell casing and an inner surface of the protective casing to prevent injury to a thigh of a user while playing with the toy.

2. A bounceable bell toy according to claim 1, wherein the belt member is provided with an adjustable tightening mechanism for securely fastening the toy to a desired portion of the user's body.

3. A bounceable bell toy according to claim 1, wherein the belt member has a fixed length and is resilient to securely fasten the toy to a desired portion of the user's body.

4. A bounceable bell toy according to claim 2, wherein the support straps are releasably fastenable to the belt member by mating pairs of touch fasteners to facilitate adjustment of the support straps relative to the belt member.

5. A bounceable bell toy according to claim 2, wherein the support members are permanently fastened to the belt member.

6. A bounceable bell toy according to claim 4, wherein the length of the support members are adjustable to facilitate adjustment of a location of the bell members relative to a thigh of a user.

7. A bounceable bell toy according to claim 4, wherein each bell casing is manufactured from metal.

8. A bounceable bell toy according to claim 7, wherein the toy comprises at least four strap supports and at least four bell members.

9. A bounceable bell toy according to claim 7, wherein the toy comprises at least eight strap supports and at least eight bell members.

10. A bounceable bell toy according to claim 4, wherein the bell member each produce a different sound, when bounced in the air during use of the toy, so that music may be played by the toy.

11. A method of utilizing a bounceable bell toy comprising:

a belt member for securing the toy to a desired portion of a user's body;

a least two strap supports having first and second opposed ends, the first end of each strap support being secured to the belt member and the second end of each strap support being secured to a protective casing; and a plurality of bell members each comprising an exterior bell casing supporting an interior clapper for striking the bell casing and generating sound, and one of said plurality of bell members being supported within each said protective casing so that said protective casing at least partially encapsulates and supports the bell casing in the protective casing while providing at least one aperture in said protective casing to allow sound generated by the clapper to be heard; and a layer of padding being provided between an exterior surface of the exterior bell casing and an inner surface of the protective casing to prevent injury to a thigh of a user while playing with the toy, said method comprising the steps of:

securely fastening the belt member to a desired portion of a body of a user; and bouncing the bell members with the thigh of the user thereby causing the bell members to bounce into the air and developing eye and thigh coordination of the user while playing with the bounceable bell toy.

12. A method according to claim 11, further comprising the step of adjusting the position of the bell members so that the bell members are located adjacent a desired portion of the thigh of the user.

13. A method according to claim 12, further comprising the step of adjusting a location of each support strap relative to the belt member to facilitate proper positioning of each bell member.

14. A method according to claim 12, further comprising the providing the toy at least four strap supports and at least four bell members.

15. A method according to claim 12, further comprising the providing the toy at least eight strap supports and at least eight bell members.

16. A bounceable bell toy for assisting a user with developing eye and thigh coordination, said toy comprising:

a belt member for securing the toy to a desired portion of a user's body;

a least two strap supports having first and second opposed ends, the first end of each strap support being secured to the belt member and the second end of each strap support being secured to a bell member; and each said bell member comprising a bell casing supporting an interior clapper for striking the bell casing and generating sound, and a protective casing at least partially encapsulating the bell casing for supporting the bell casing in the protective casing while providing at least one aperture in said protective casing to allow sound generated by the clapper to be heard; and a layer of padding being provided between an exterior surface of the bell casing and an inner surface of the protective casing to prevent injury to a thigh of a user while playing with the toy.

* * * * *